US008292342B2

(12) United States Patent
Lord

(10) Patent No.: US 8,292,342 B2
(45) **Date of Patent: *Oct. 23, 2012**

(54) PLATE HOLDER

(76) Inventor: Andrew Lord, Redondo Beach, CA (US)

( * ) Notice: Subject to any disclaimer, the term of this patent is extended or adjusted under 35 U.S.C. 154(b) by 677 days.

This patent is subject to a terminal disclaimer.

(21) Appl. No.: 12/424,490

(22) Filed: Apr. 15, 2009

(65) Prior Publication Data

US 2009/0195005 A1 Aug. 6, 2009

Related U.S. Application Data

(63) Continuation-in-part of application No. 11/301,539, filed on Dec. 13, 2005, now Pat. No. 7,520,550.

(51) Int. Cl.
*A45F 5/00* (2006.01)

(52) U.S. Cl. ..... 294/161; 294/143; 220/914

(58) Field of Classification Search ..... 294/25, 294/143, 144, 161, 163; 211/71.01, 41.2, 211/49.1; D7/705, 706; 220/23.8, 556, 570, 220/914; 206/557; 224/219, 222
See application file for complete search history.

(56) References Cited

U.S. PATENT DOCUMENTS

| | | | | |
|---|---|---|---|---|
| 544,055 | A | 8/1895 | Smith | |
| 953,007 | A | 3/1910 | Haller | |
| 1,379,379 | A * | 5/1921 | Abrahmsen | 211/41.4 |
| 1,888,141 | A | 11/1932 | Orth | |
| 2,087,375 | A | 7/1937 | Ehrnhardt | |
| 5,062,674 | A * | 11/1991 | Magee | 294/143 |
| 5,064,236 | A | 11/1991 | Stanfield | |
| 5,104,168 | A * | 4/1992 | Magee | 294/143 |
| 5,152,398 | A * | 10/1992 | Forestal et al. | 206/561 |
| 5,542,731 | A | 8/1996 | Wills | |
| D427,026 | S | 6/2000 | Wang | |
| 7,520,550 | B2 * | 4/2009 | Lord | 294/161 |

* cited by examiner

*Primary Examiner* — Paul T Chin
(74) *Attorney, Agent, or Firm* — Kenneth L. Green

(57) ABSTRACT

A plate carrier is carried on a server's forearm. The carrier comprises a wireform having a horizontal support portion for carrying the plate carrier on the forearm, a vertical loop portion looping around a server's forearm, and a plate holder portion below the server's forearm. The horizontal support is carried between the elbow and the palm. The vertical loop portion centers the plate holder portion under the server's forearm and the plate holder portion positions the plate holders centered under the forearm longitudinally closer to the elbow than the palm. The plate holders comprise a stationary lower jaw and a pivoting upper jaw allowing adjustment to hold a variety of plates.

15 Claims, 7 Drawing Sheets

PLATE HOLDER

The present application is a Continuation In Part of U.S. patent application Ser. No. 11/301,539 filed Dec. 13, 2005, which application is incorporated in its entirety herein by reference.

BACKGROUND OF THE INVENTION

The present invention relates to a plate carrier, and more particularly to a plate carrier for use by servers in a restaurant.

Servers at restaurants often prefer to carry a number of plates in each trip between a kitchen and diner's table to minimize the number of trips necessary to provide meals and to clear the tables. Generally, plates are carried on a large tray. Unfortunately, if the server is bumped or stumbles, the plates may fall off the tray, and possibly onto diners.

U.S. Pat. No. 953,007 for "Serving Rack," describes a rack for use by waiters in hotels, restaurants, etc. The rack includes a handle and a vertical member extending down from the handle. A multiplicity of substantially round wire loops reside on opposite sides of the vertical member and are adapted for supporting plates and cups of various sizes. A supporting member resides at the bottom of the vertical member, thus allowing the rack to be placed horizontal surfaces when not being carried by a waiter. Unfortunately, the carrier of the '007 patent requires an awkward hand and arm position, resulting in rapid fatigue of the server. Other plate carriers are known, but they similarly require carrying by the hand, and are also awkward and fatiguing.

U.S. patent application Ser. No. 11/301,539 filed Dec. 13, 2005 by the present inventor discloses a plate carrier for carrying on a waiter's forearm. The plate carrier of the '539 application allows a waiter to easily carry more plates than known plate carriers. However, a three prong plate holder disclosed by the '539 application may not securely hold a potentially wide variety of plates.

BRIEF SUMMARY OF THE INVENTION

The present invention addresses the above and other needs by providing a plate carrier which is carried on a server's forearm. The carrier comprises a wireform having a horizontal support portion for carrying the plate carrier on the forearm, a vertical loop portion looping around a server's forearm, and a plate holder portion below the server's forearm. The horizontal support is carried between the elbow and the palm. The vertical loop portion centers the plate holder portion under the server's forearm and the plate holder portion positions the plate holders centered under the forearm longitudinally closer to the elbow than the palm. The plate holders comprise a stationary lower jaw and a pivoting upper jaw allowing adjustment to hold a variety of plates.

In accordance with one aspect of the invention, there is provided a plate carrier comprising a horizontal support portion, a looping portion, and a plate holder portion below the looping portion. The horizontal support has a substantially rectangular shape, resides horizontally, and has a support length of approximately eight inches and support width of approximately 1.5 inches. The looping portion is attached to the horizontal support and extends downward from the horizontal support looping around the forearm. The loop portion has a height $H_L$ of approximately 4.5 inches and a depth $D_L$ of approximately 1.5 inches, and a plate holder portion below the loop portion. The plate holder portion is approximately laterally centered under the horizontal support portion. At least one plate holder is attached to the plate holder portion.

In accordance with another aspect of the invention, there is provided a plate holder. The plate holder includes a stationary lower jaw attached to the plate holder portion and a pivoting upper jaw slidably engaging the lower jaw at a forward end. The stationary lower jaw includes a lower jaw rear portion connected to the plate holder portion of the wireform, a vertical slot extending forward from the lower jaw rear portion and open at a forward slot end opposite the lower jaw rear portion, one downward hooking hook of the stationary lower jaw, a pair of horizontally spaced apart upward facing bumpers on opposite sides of the vertical slot for contacting a lower surface of a rim of the plate and a pin extending through the vertical slot at the forward slot end. The pivoting upper jaw includes an elongated lower tongue residing in the vertical slot in the stationary lower jaw, a horizontal oval slot in the elongated lower tongue, an upper lip with a downward facing contacting feature for contacting an upper surface of the rim of the plate, a mouth between the elongated lower tongue and the upper lip for receiving the rim of the plate, a plurality of vertically spaced apart upward hooking hooks residing on a rear face of the pivoting upper jaw for cooperating with one downward hooking hook of the stationary lower jaw for adjusting the plate holder for various plate sizes and a single downward facing rubber bumper for contacting an upper surface of the rim of the plate. The pin passing through the horizontal oval slot in the elongated lower tongue allowing the elongated lower tongue of the pivoting upper jaw to move forward and rearward in the vertical slot in the stationary lower jaw for engaging and disengaging the plurality of vertically spaced apart upward hooking hooks with the one downward hooking hook of the stationary lower jaw.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1C:
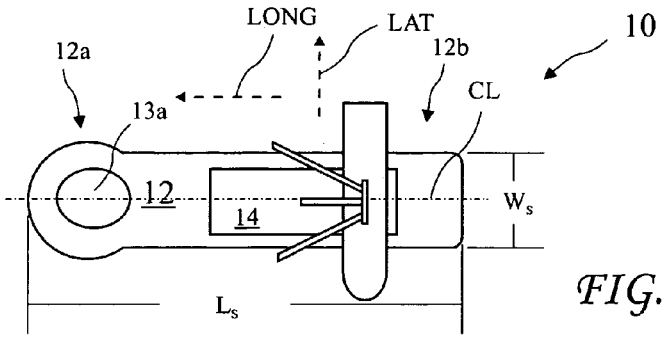
FIG. 1C is a top view of the plate carrier.
Figure 1A:
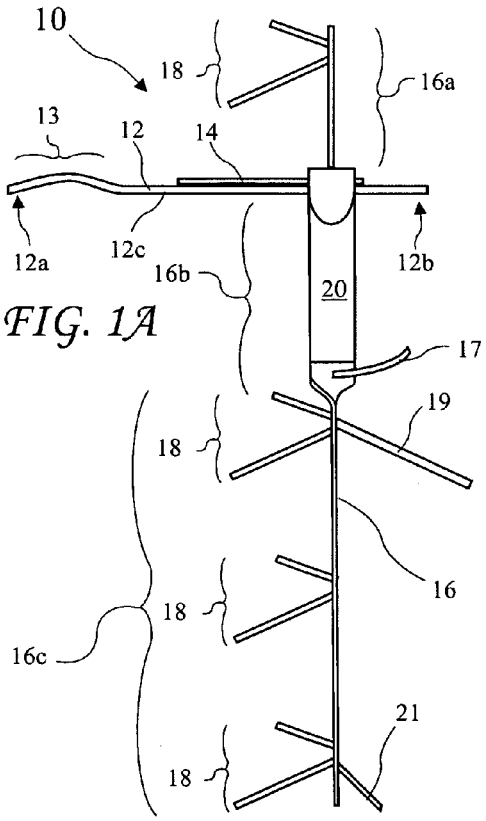
FIG. 1A is a side view of a plate carrier according to the present invention.
Figure 1B:
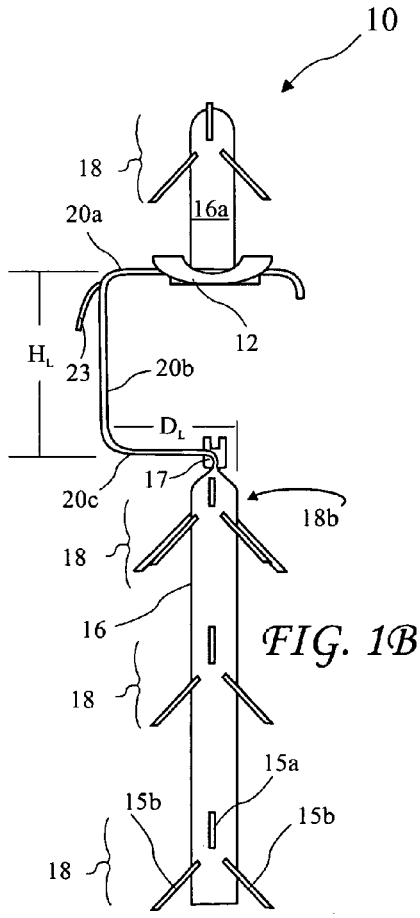
FIG. 1B is a front view of the plate carrier.

A side view of a plate carrier 10 according to the present invention is shown in FIG. 1A, a front view of the plate carrier 10 is shown in FIG. 1B, and a top view of the plate carrier 10 is shown in FIG. 1C. The plate carrier 10 includes a horizontal support 12 and a spine 16. The horizontal support 12 has a length $L_S$ and a width $W_S$. The length $L_S$ is preferably between approximately two inches and approximately twelve inches and more preferably is approximately eight inches. The width $W_S$ is preferably between approximately one inch and approximately two inches, and more preferable approximately 1.5 inches. The plate carrier 10 has a centerline CL which aligns with a server's forearm.

The horizontal support 12 is preferably substantially rectangular with rounded corners and includes a forward (to the left in FIG. 1A) end 12*a* and a rearward end 12*b* opposite the forward end. The horizontal support 12 includes a support surface 12*c* configured to carry on a server's forearm. The support surface preferably includes an upwardly arched portion 13 proximal to the forward end 12*a* to cooperate with (or follow) a server's hand. The upward arched portion 13 is rounded and somewhat resembles a large inverted spoon and includes a thumb hole 13 for the server's thumb. The horizontal support 12 may be made from a flexible or soft material and a support bracket 14 may be attached to the spine 16, and the horizontal support member 12 may be attached to the support bracket 14.

The spine 16 is connected to the horizontal support 12 proximal to the rearward end 12*b*. The spine 16 includes a loop portion 16*b* under the horizontal support 12, which loop portion 16*b* loops around the server's forearm. The loop portion 16*b* resides just under the horizontal support 12 aligned with the support width (for example, the loop portion 16*b* resides in a plane parallel with the support width and perpendicular with the support length) and forms a vertical loop circling a user's forearm when in use and carrying a plate holder portion 16*c* approximately laterally centered under the horizontal support 12. The loop portion 16*b* includes a horizontal upper portion 20*a*, a vertical center portion 20*b*, and a horizontal lower portion 20*c*. The loop portion 16*b* has a height $H_L$ of between approximately four inches and approximately five inches and preferably approximately 4.5 inches and a depth $D_L$ of between approximately 1.5 inches and approximately 2.5 inches and preferably approximately 1.5 inches. The spine 16 further includes a plate holder portion 16*c* under the loop portion 16*b*. At least one plate holder 18 is attached to the plate holder portion 16*c* for holding plates, and preferably three forward pointing vertically spaced apart plate holders 18 are attached to the portion 16*c* and pointing forward (to the left in FIG. 1A). The plate holders 18 may be the same size, or may be different sizes for different size plates. The spine 16 may further include a spine upper portion 16*a* extending upward from the horizontal support 12, and having a fourth plate holder 18 attached.

Feet 21 are attached to the spine 16 proximal to the bottom of the spine 16, and extend angled downward from the spine 16 opposite a bottom most plate holder 18. The feet extend downward approximately as far as the bottom of the spine 16. A pepper mill holder 17 is attached to the spine proximal to the top of the plate holder portion 16*c*. The pepper mill holder 17 faced to the rear (right in FIG. 1A) and is forked to cooperate with the pepper mill holder 17. A carrying hook 23 is attached to the spine near the horizontal carrier 12 to allow the place carrier 10 to be hooked over a belt, pocket, and the like to free up the server's arms and/or hands. A pair of stabilizers 19 are attached to the spine 16 proximal to the top of the plate carrier portion 16*c*. The stabilizers 19 may rest against the server's side while carrying the plate carrier 10, or may be hooked or rest on the server's belt, pocket, or the like.

The plate holders 18 may be any structure suitable for holding a plate to the plate carrier 10. For example, each plate holder 18 may comprise three pins extending from the spine 16, and may preferably comprise two downward angled pins 15*b* and one pin is an upward angled pin 15*a*. A plate is inserted between the pins 15*a* and 15*b* to hold the plate. The pins 15*a* and 15*b* may be coated with a latex, a rubber or other sticky material to facilitate holding the plates. Such pins 15*a* and 15*b* advantageously accommodate a variety of plate sizes and shapes. The plate holders may also be wire loops to set plates onto, or solid cupped holders to set plates into, or be spring clamps, or the like.

Figure 2:
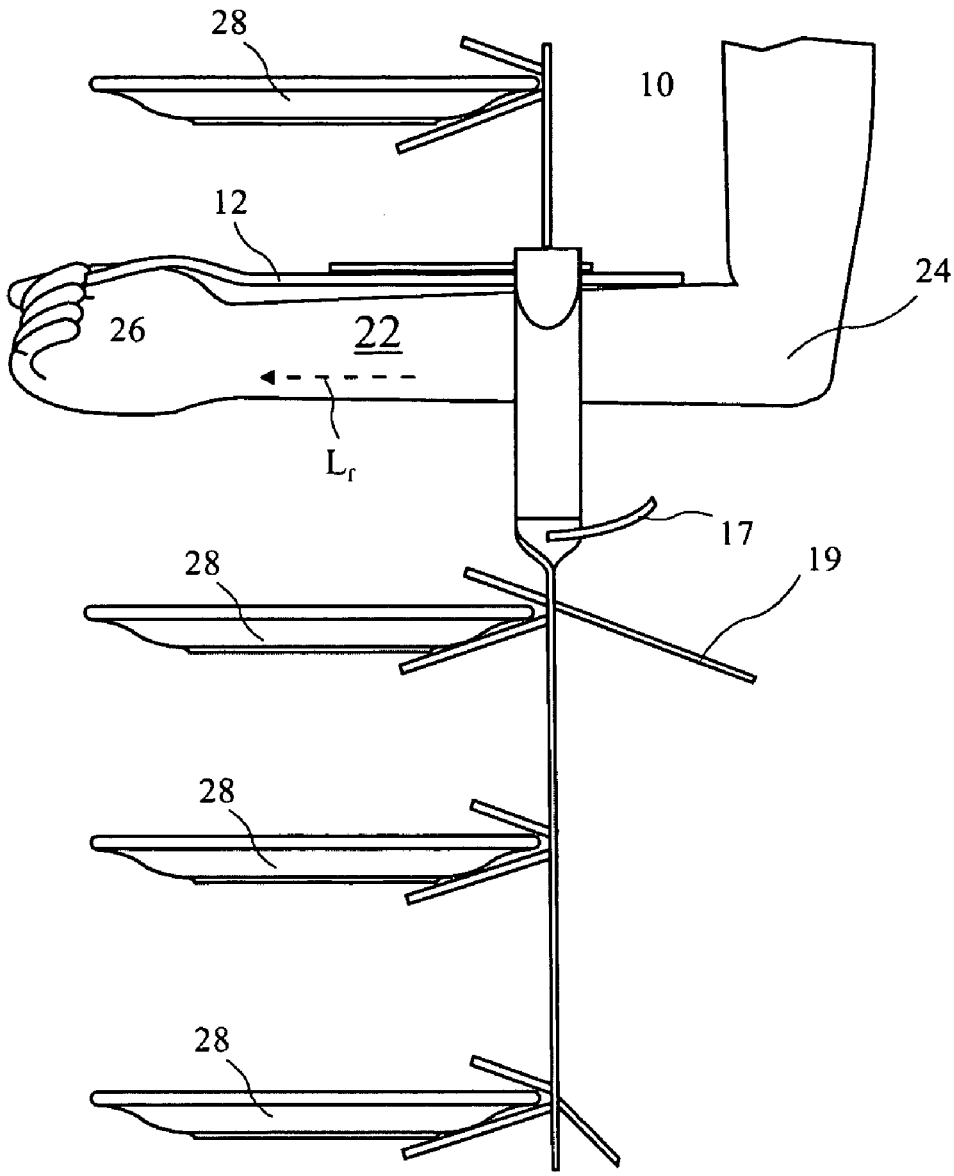
FIG. 2 depicts the plate carrier resting on a forearm and holding plates.

The plate carrier 10 is shown resting on a server's forearm 22 and holding plates 28 in FIG. 2. The length $L_F$ (see FIG. 1C) of the horizontal support 12 is aligned with the centerline CL of the forearm. The horizontal support 12 extends from near the elbow 24 to the hand 26, more or less depending on the forearm length of the server. In the instance of a plate carrier 10 with a short horizontal support 12, the plate carrier 10 may be carried at any position along the forearm, or even by the hand 26. The plates 28 are carried forward (to the left in FIG. 2) of the spine 16, and the spine 16 is attached to the horizontal support 12 toward the rear 12*b* (see FIG. 1A) of the horizontal support 12 to provide for balanced carrying. The server may further insert a thumb or finger through the thumb hole 13*a* (see FIG. 1C) in the forward end 12*a* of the horizontal support 12 to hold the plate carrier 10 more securely.

Figure 3:
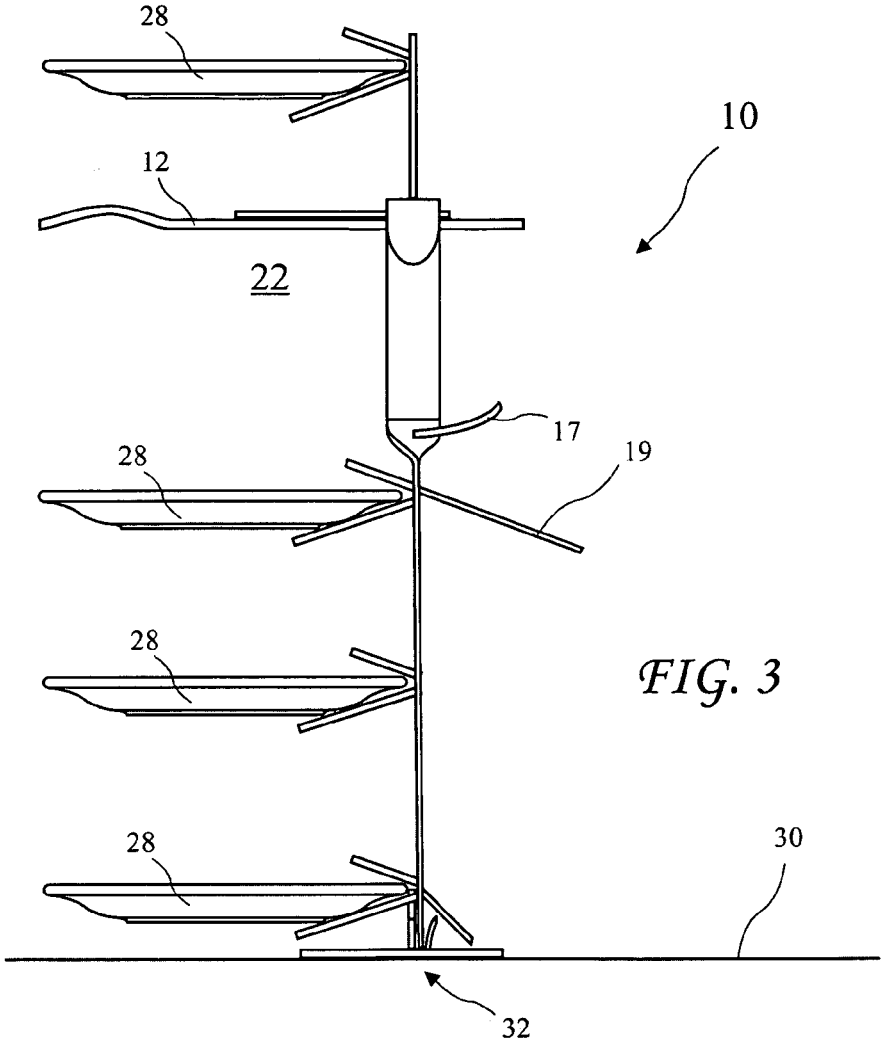
FIG. 3 is a side view of the plate carrier supported by a stand.

The plate carrier 10 may further be supported on a substantially flat surface 30 by the feet 21 and a stand 32 as shown in FIG. 3, wherein the plate carrier 10 is held in a substantially vertical position thereby allowing plates to be held by the plate holders. The plate carrier 10 thus supported may receive plates in preparation for delivery by the server to a table. Because the plates reside in a vertically spaced apart manner on the plate carrier, the kitchen and/or serving area required for the plate carrier is minimized. The plate carrier 10 may alternatively include a flat plate, cone, or rounded base to provide support on a horizontal surface. The plate carrier 10 may further include a downward pointing pin to insert into a receiving hole to support the plate carrier 10, for example, a pin pointing downward from a rounded base.

Figure 4A:
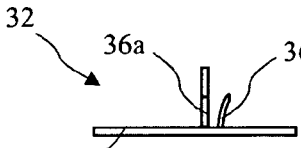
FIG. 4A is a side view of the stand for the plate carrier.
Figure 4B:
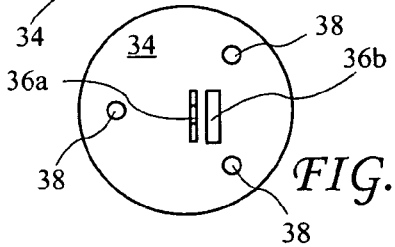
FIG. 4B is a top view of the stand for the plate carrier.
Figure 4C:
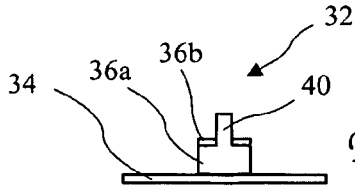
FIG. 4C is an front view of the stand for the plate carrier.

A detailed side view of the stand 32 is shown in FIG. 4A, a top view of the stand 32 is shown in FIG. 4B, and an end view of the stand 32 is shown in FIG. 4C. The stand comprises a base 34 which may be a small base fixed to a surface using fasteners passing through mounting holes 38, or the base 34 may also be a larger base providing stable support without fixing to a surface. The stand 32 includes a first positioner 36*a* and a second positioner 36*b*. The base of the spine 16 resides between the positioners 36*a*, 36*b*, and the feet 21 (see FIG. 1A) which hold the plate carrier 10 in a substantially vertical position. The positioner 36*a* includes an upwardly extending extension 40 which resides between the bottom most downward pointing pins 15 (see FIG. 1B) to better support the plate carrier 10. The positioner 36*b* curves away from the positioner 36*a* to facilitate insertion of the base of the spine 16 into the stand 32.

Figure 5A:
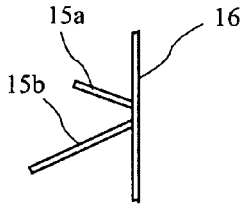
FIG. 5A is a side view of a first alternative plate holder.
Figure 5B:
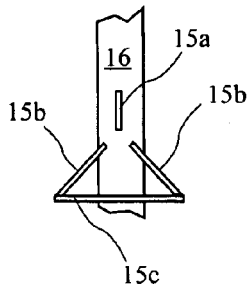
FIG. 5B is a front view of the first alternative plate holder.

A side view of a first alternative plate holder is shown in FIG. 5A, and a front view of the first alternative plate holder is shown in FIG. 5B. The first alternative plate holder is similar to the plate holder 18 (see FIGS. 1A and 1B) but includes a horizontal pin 15*c* connecting the lower pins 15*b*.

Figure 5C:
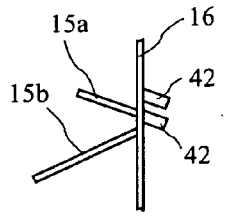
FIG. 5C is a side view of a plate carrier with an adjustable upper pin height.

A side view of a plate carrier with an adjustable upper pin height is shown in FIG. 5C. Pockets 42 are attached to a back side of the spine 16. The pockets have open mouths for insertion of the upper pin 15*a*, and closed ends to hold the pin 15*a*. Two or more pockets 42 are vertically spaced apart on the spine 16 to allow vertical adjustment of the upper pin 15*a* to accommodate various plate sizes.

Figure 6A:
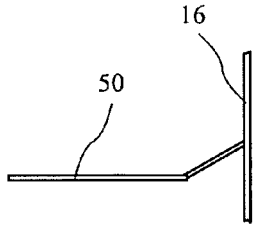
FIG. 6A is a side view of a second alternative plate holder.
Figure 6B:
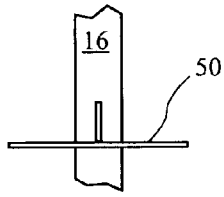
FIG. 6B is a front view of the second alternative plate holder.
Figure 6C:
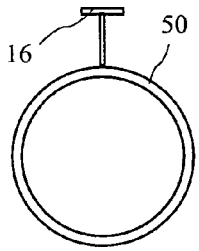
FIG. 6C is a top view of the second alternative plate holder.

A side view of a second alternative plate holder is shown in FIG. 6A, a front view of the second alternative plate holder is shown in FIG. 6B, and a top view of the second alternative plate holder is shown in FIG. 6C. The second alternative plate holder comprises a wire loop 50 is attached to the spine 16, and plates are carried on the wire loop 50.

Figure 7C:
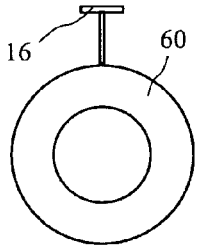
FIG. 7C is a top view of the third alternative plate holder.
Figure 7A:
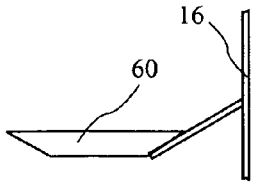
FIG. 7A is a side view of a third alternative plate holder.
Figure 7B:
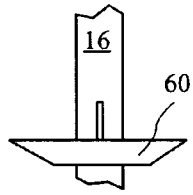
FIG. 7B is a front view of the third alternative plate holder.

A side view of a third alternative plate holder is shown in FIG. 7A, a front view of the third alternative plate holder is shown in FIG. 7B, and a top view of the third alternative plate holder is shown in FIG. 7C. The third alternative plate includes a cup 60 for holding plates. The cup 60 is attached to the spine 16 by an arm 62. The cup 60 resides substantially orthogonal to the spine 16, and is sufficiently close to being orthogonal to carry plates without the plates easily slipping. The cup 60 is preferably dished and may be solid, or include slots, perforations, or the like.

Figure 8B:
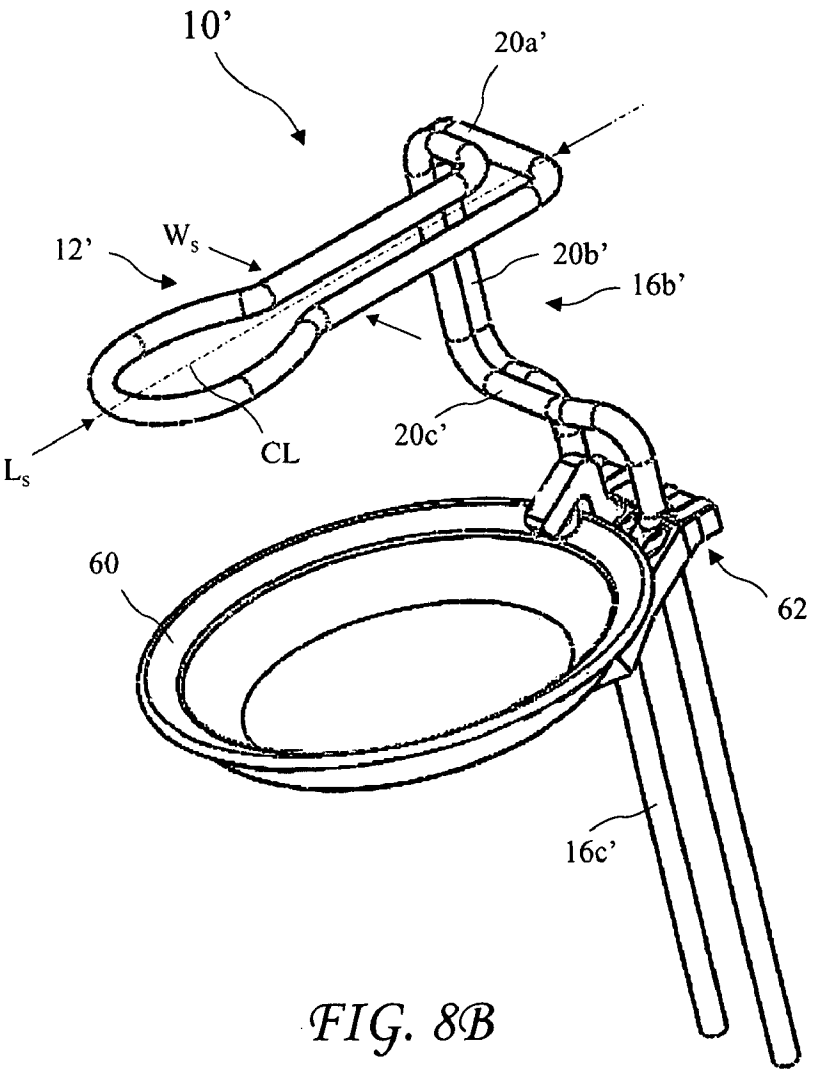
FIG. 8B shows a top perspective view of the second plate carrier having the second plate holder according to the present invention holding the plate.
Figure 8A:
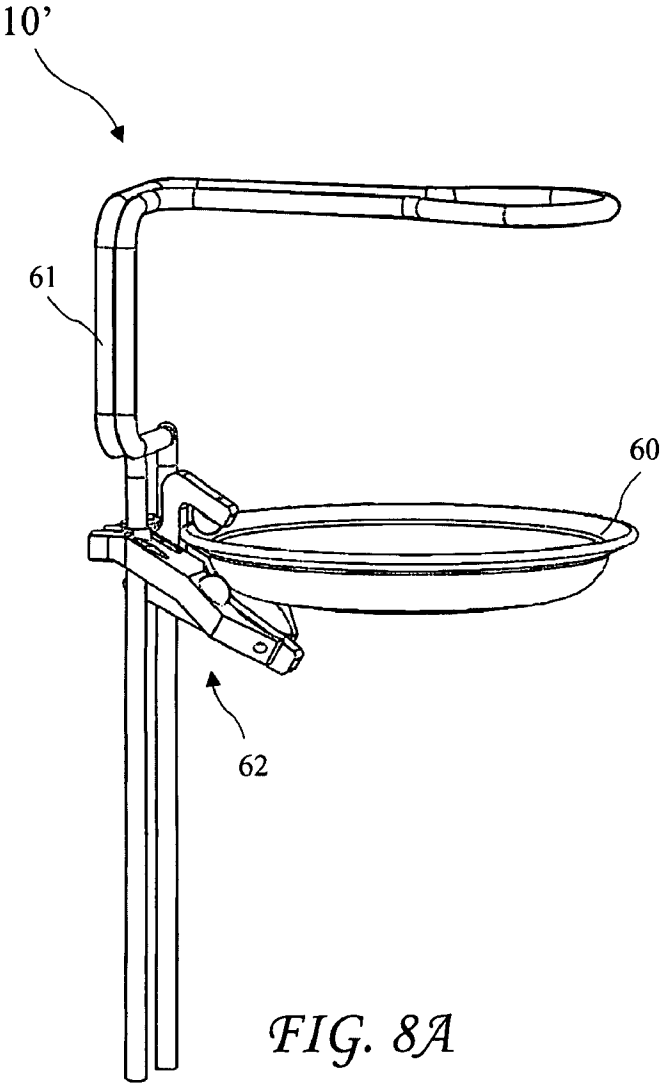
FIG. 8A shows a side perspective view of a second plate carrier having a second plate holder according to the present invention holding the plate.

A side perspective view of a second plate carrier 10' having a second plate holder 62 according to the present invention is shown holding a plate 60 in FIG. 8A and in a top perspective view of the second plate holder 62 holding the plate 60 is shown in FIG. 8B. The second plate carrier 10' has a wireform frame 61 having the same basic shape and function as the plate carrier 10 in FIG. 1A-1C. The wireform frame 61 includes a horizontal support portion 12' having longitudinal support length $L_S$ parallel to the centerline CL and a lateral support width $W_S$ perpendicular to the centerline CL. The wireform frame 61 further includes a loop portion 16*b'* comprising a horizontal upper portion 20*a'*, a vertical center portion 20*b'*, and a horizontal lower portion 20*c'*. The loop portion has a height $H_L$ of between approximately four inches and approximately five inches and preferably approximately 4.5 inches and a depth $D_L$ of between approximately 1.5 inches and approximately 2.5 inches and preferably approximately 1.5 inches (see FIG. 1B for definitions of height $H_L$ and depth $D_L$). A plate holder portion 16*c'* extends down from the lower segment 20*c'* of the loop portion 16*b'*, the plate holder portion 19*c'* is approximately laterally centered under the horizontal support portion 12' by the loop portion 16*b'*

Figure 9:
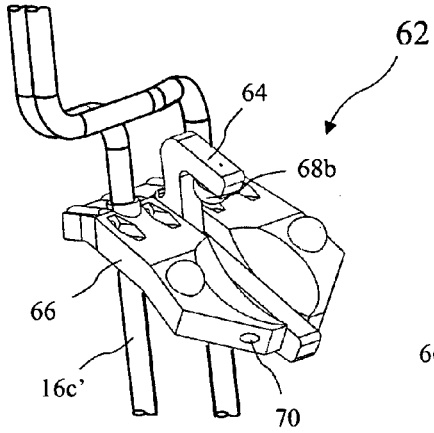
FIG. 9 is a perspective view of the second plate holder according to the present invention.
Figure 10:
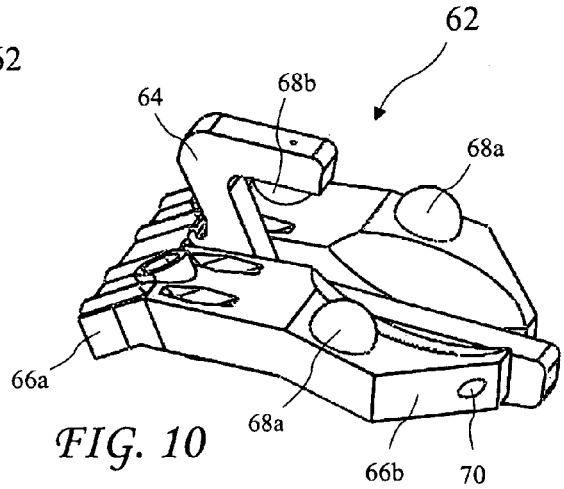
FIG. 10 is a second perspective view of the second plate holder according to the present invention.

A first perspective view of the second plate holder 62 according to the present invention attached to the plate holder portion 16*c'* of the wireframe 61 is shown in FIG. 9 and a second perspective view of the second plate holder 62 alone is shown in FIG. 10. The second plate holder 62 includes a stationary lower jaw 66 attached to the plate holder portion 16*c'* of the wireframe and a pivoting upper jaw 64 slidably engaging the lower jaw 66 at a forward end 66*b* and having hooks (see FIGS. 13 and 14) for engaging the lower jaw 66 at a rearward end 66*a* of the lower jaw 66. The stationary lower jaw rear portion 66*a* is preferably a separate piece of the stationary lower jaw 66 which attaches to the rest of the stationary lower jaw 66 to grasp (or sandwich) the plate holder portion 16*c'* of the wireform 61 to attach the plate holder 62 to the wireframe 61, but a plate holder according to the present invention attached to any plate holder portion of a plate carrier by any means is intended to be within the scope of the present invention.

Figure 11A:
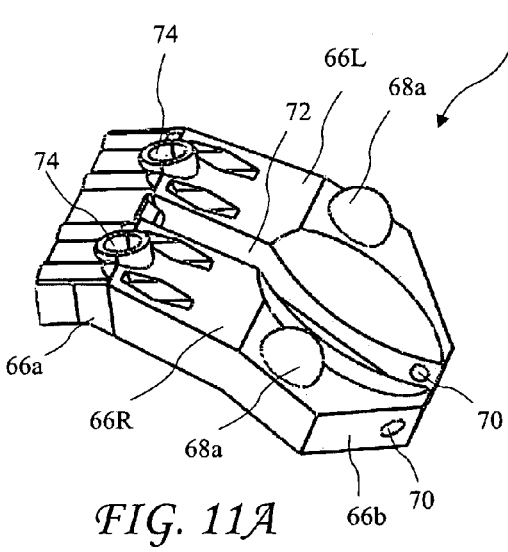
FIG. 11A is a perspective view of a lower jaw of the second plate holder according to the present invention.
Figure 11B:
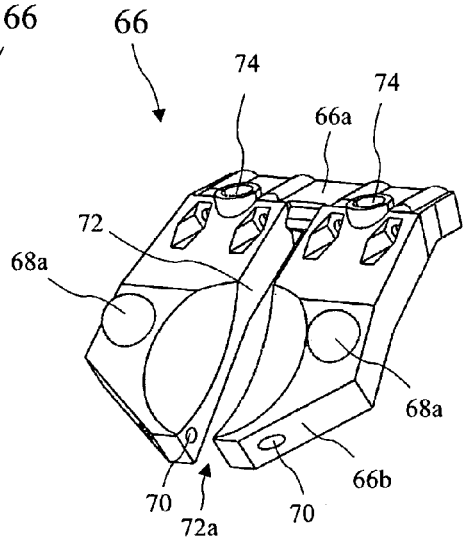
FIG. 11B is a second perspective view of the lower jaw of the second plate holder according to the present invention.

A first perspective view of the lower jaw 66 alone is shown in FIG. 11A and a second perspective view of the lower jaw 66 alone is shown in FIG. 11B. A vertical slot 72 extends forward from the lower jaw rear portion 66*a* and opens at a forward slot end 72*a* opposite the lower jaw rear portion 66*a*. The stationary lower jaw may be constructed from three parts, the stationary lower jaw rear portion 66*a*, and right 66R and left 66L forward parts attached to the stationary lower jaw rear portion 66*a*, and sandwiching (or clamping) the two parallel elements of the plate holder portion 16*c'* in passages 74 between the stationary lower jaw rear portion 66*a* and the right 66R and left 66L forward parts. A pair of horizontally spaced apart upward facing bumpers 68*a* on opposite sides of the vertical slot 72 contact a lower surface of a rim of the plate 60 and a single downward facing bumper 68*b* (see FIGS. 13 and 14) attached to an upper lip 84 of the pivoting upper jaw 64 contacts an upper surface of the rim of the plate 60 to hold the plate.

Figure 14:
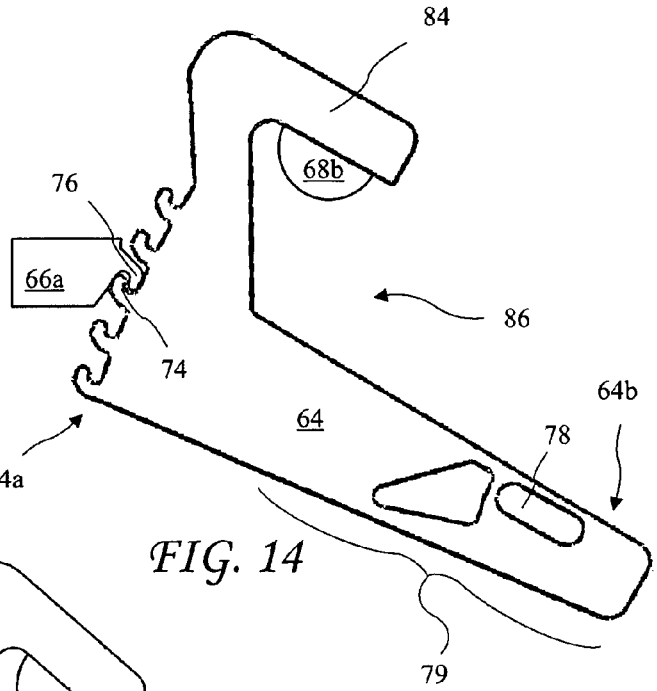
FIG. 14 shows the engagement of downward facing hooks of the lower jaw with the upward facing hooks of the upper jaw.
Figure 13:
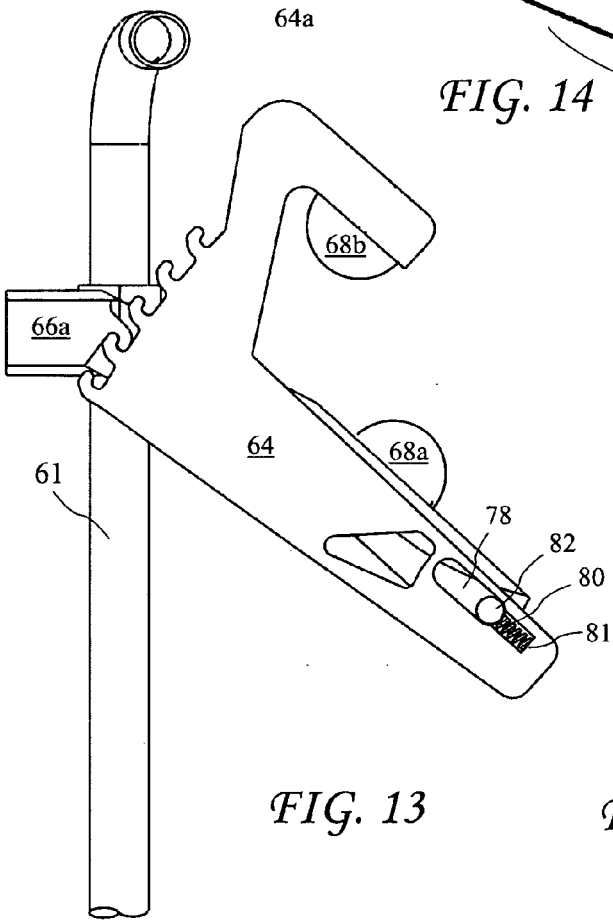
FIG. 13 is a cross sectional view of the second plate holder according to the present invention taken along line 13-13 of FIG. 12 showing the engagement of the lower jaw with an upper jaw.
Figure 12:
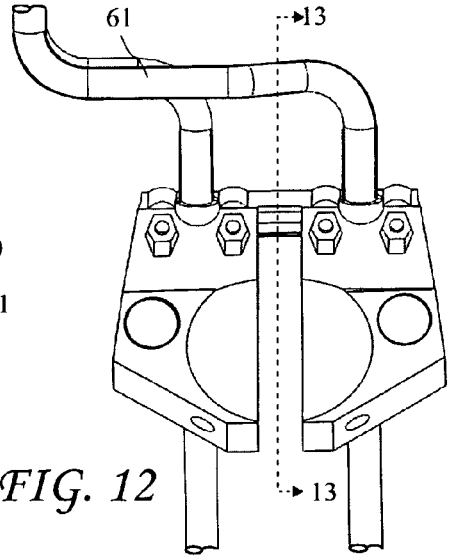
FIG. 12 is a front view of the lower jaw of the second plate holder according to the present invention.

A front view of the plate holder 62 attached to the plate holder portion 16*c'* is shown in FIG. 12, a cross sectional view of the plate holder 62 (with the pivoting upper jaw 64 added) taken along line 13-13 of FIG. 12 showing the engagement of the stationary lower jaw 66 with the pivoting upper jaw 64 is shown in FIG. 13, and a more detailed view of the engagement of a downward facing hook 76 of the stationary lower jaw 66, with one of the upward facing hook 74 of the pivoting upper jaw, is shown in FIG. 14. The one downward hooking hook 76 of the stationary lower jaw engages one of a plurality of upward hooking hooks 74 on a rear surface of the pivoting upper jaw 64 for adjusting the plate holder 62 for various plate sizes. A mouth 86 is formed between an upper lip 84 and the elongated lower tongue 79 and the upper lip 84 for receiving the rim of the plate 60.

A pin 82 is held captive in the pin passages 70 (see FIGS. 9-11B) and extends across the vertical slot 72 of the stationary lower jaw 66 at the forward end 72*a* of the vertical slot 72. The pin 82 passes through a horizontal oval slot 78 in an elongated tongue portion 79 of the forward end 64*b* of the pivoting upper jaw 64. Additionally, a spring 80 is held in position by a spring seat 81 in the forward end 64*b* of the pivoting upper jaw 64. The spring 80 pushed against the pin 82 thereby applying forward force on the pivoting upper jaw 64 to disengage the hooks 74 and 76 when the plate 60 is removed from the mouth 86.

The plate carrier 10 may be made from solid metal or plastic, for example, the spine 16 may be made from metal bar or strap as shown herein, or the plate carrier 10 may be a wireform as shown in FIGS. 8A and 8B.

While the invention herein disclosed has been described by means of specific embodiments and applications thereof, numerous modifications and variations could be made thereto by those skilled in the art without departing from the scope of the invention set forth in the claims.

I claim:

1. A plate carrier comprising:

a wireform comprising:

a horizontal support portion having a centerline and configured for carrying on a forearm of a server with the centerline of the horizontal support portion aligned with a forearm length $L_F$ of the forearm and having a longitudinal support length $L_S$ parallel to the centerline and a lateral support width $W_S$ perpendicular to the centerline, the support width $W_S$ extending across the forearm while carried;

a vertical loop portion aligned with the support width $W_S$ and having a loop height $H_L$ and a loop depth $D_L$ and comprising an upper segment residing adjacent to the horizontal support portion, a center segment laterally displaced from the horizontal support centerline and extending downward from the upper segment, and a lower segment returning perpendicular to the centerline of the horizontal support portion under the horizontal support portion allowing the horizontal support portion to be carried on the forearm with the loop portion looping around the forearm; and a plate holder portion extending down from the lower segment of the loop portion, the plate holder portion approximately laterally centered under the horizontal support portion by the loop portion; and at least one plate holder attached to the plate holder portion and aligned parallel to the centerline of the horizontal support portion and configured for carrying plates laterally centered under the horizontal support portion, the plate holder comprising:

a stationary lower jaw attached to the plate holder portion; and a pivoting upper jaw slidably engaging the lower jaw at a forward end and having a plurality of rear engagement positions with respect to the stationary lower jaw for adjusting the plate holder for various plate sizes.

2. The plate carrier of claim 1, wherein:

the stationary lower jaw includes:

a lower jaw rear portion connected to the plate holder portion of the wireform;

a vertical slot extending forward from the lower jaw rear portion and open at a forward slot end opposite the lower jaw rear portion;

an upward facing contacting feature for contacting a lower surface of a rim of the plate; and a pin extending through the vertical slot at the forward slot end;

the pivoting upper jaw includes:

an elongated lower tongue residing in the vertical slot in the stationary lower jaw;

a horizontal oval slot in the elongated lower tongue;

an upper lip with a downward facing contacting feature for contacting an upper surface of the rim of the plate; and a mouth between the elongated lower tongue and the upper lip for receiving the rim of the plate;

a downward facing contacting feature for contacting an upper surface of the rim of the plate; and the pin passes through the horizontal oval slot in the elongated lower tongue allowing the elongated lower tongue of the pivoting upper jaw to move forward and rearward in the vertical slot in the stationary lower jaw.

3. The plate carrier of claim 2, wherein the plurality of rear engagement positions comprise the cooperation of at least one downward hooking hook of the stationary lower jaw with at least one upward facing hook residing on a rear face of the pivoting upper jaw for adjusting the plate holder for various plate sizes.

4. The plate carrier of claim 3, wherein the at least one upward facing hook residing on a rear face of the pivoting upper jaw comprises a plurality of vertically spaced apart upward hooking hook residing on a rear face of the pivoting upper jaw cooperating with one downward hooking hook of the stationary lower jaw for adjusting the plate holder for various plate sizes.

5. The plate carrier of claim 2, wherein:

the upward facing contacting feature of the stationary lower jaw comprises a pair of horizontally spaced apart upward facing rubber bumpers on opposite sides of the vertical slot; and the downward facing contacting feature comprises a single downward facing rubber bumper.

6. The plate carrier of claim 1, wherein the support width $W_S$ is between approximately one inch and approximately two inches.

7. The plate carrier of claim 6, wherein the support length $L_S$ is between approximately two inches and approximately twelve inches.

8. The plate carrier of claim 7, wherein the support length $L_S$ is approximately eight inches.

9. The plate carrier of claim 1, wherein the lower segment of the loop portion returns to approximately a center of the support width $W_S$ of the horizontal support portion.

10. The plate carrier of claim 1, wherein the loop height $H_L$ is approximately 4.5 inches and the loop depth $D_L$ is approximately two inches.

11. The plate carrier of claim 1, wherein the at least one plate holder comprises two downward angled pins and one upward angled pin.

12. The plate carrier of claim 1, wherein the at least one plate holder comprises at least one forward facing plate holder.

13. The plate carrier of claim 2, further including a spring applying force on the pivoting upper jaw pushing the pivoting upper jaw away from the stationary lower jaw.

14. A plate carrier comprising:

a wireform comprising:

a horizontal support portion having a centerline and configured for carrying on a forearm of a server with the centerline of the horizontal support portion aligned with a forearm length $L_F$ of the forearm and having a longitudinal support length $L_S$ parallel to the centerline and a lateral support width $W_S$ perpendicular to the centerline, the support width $W_S$ extending across the forearm while carried;

a vertical loop portion aligned with the support width $W_S$ and having a loop height $H_L$ and a loop depth $D_L$ and comprising an upper segment residing adjacent to the horizontal support portion, a center segment laterally displaced from the horizontal support centerline and extending downward from the upper segment, and a lower segment returning perpendicular to the centerline of the horizontal support portion under the horizontal support portion allowing the horizontal support portion to be carried on the forearm with the loop portion looping around the forearm; and a plate holder portion extending down from the lower segment of the loop portion, the plate holder portion approximately laterally centered under the horizontal support portion by the loop portion; and at least one plate holder attached to the plate holder portion and aligned parallel to the centerline of the horizontal support portion and configured for carrying plates laterally centered under the horizontal support portion, the plate holder comprising:

a stationary lower jaw attached to the plate holder portion, the stationary lower jaw comprising:

a lower jaw rear portion connected to the plate holder portion of the wireform;

a vertical slot extending forward from the lower jaw rear portion and open at a forward slot end opposite the lower jaw rear portion;

one downward hooking hook of the stationary lower jaw;

a pair of horizontally spaced apart upward facing bumpers on opposite sides of the vertical slot for contacting a lower surface of a rim of the plate; and a pin extending through the vertical slot at the forward slot end;

a pivoting upper jaw slidably engaging the lower jaw at a forward end, the pivoting upper jaw comprising:

an elongated lower tongue residing in the vertical slot in the stationary lower jaw;

a horizontal oval slot in the elongated lower tongue;

an upper lip with a downward facing contacting feature for contacting an upper surface of the rim of the plate;

a mouth between the elongated lower tongue and the upper lip for receiving the rim of the plate;

a plurality of vertically spaced apart upward hooking hooks residing on a rear face of the pivoting upper jaw for cooperating with one downward hooking hook of the stationary lower jaw for adjusting the plate holder for various plate sizes; and a single downward facing rubber bumper for contacting an upper surface of the rim of the plate; and the pin passing through the horizontal oval slot in the elongated lower tongue allowing the elongated lower tongue of the pivoting upper jaw to move forward and rearward in the vertical slot in the stationary lower jaw for engaging and disengaging the plurality of vertically spaced apart upward hooking hooks with the one downward hooking hook of the stationary lower jaw.

15. A plate holder comprising:

a stationary lower jaw attached to the plate holder portion, the stationary lower jaw comprising:

a lower jaw rear portion connected to the plate holder portion of the wireform;

a vertical slot extending forward from the lower jaw rear portion and open at a forward slot end opposite the lower jaw rear portion;

one downward hooking hook of the stationary lower jaw;

a pair of horizontally spaced apart upward facing bumpers on opposite sides of the vertical slot for contacting a lower surface of a rim of the plate; and a pin extending through the vertical slot at the forward slot end;

a pivoting upper jaw slidably engaging the lower jaw at a forward end, the pivoting upper jaw comprising:

an elongated lower tongue residing in the vertical slot in the stationary lower jaw;

a horizontal oval slot in the elongated lower tongue;

an upper lip with a downward facing contacting feature for contacting an upper surface of the rim of the plate;

a mouth between the elongated lower tongue and the upper lip for receiving the rim of the plate;

a plurality of vertically spaced apart upward hooking hooks residing on a rear face of the pivoting upper jaw for cooperating with one downward hooking hook of the stationary lower jaw for adjusting the plate holder for various plate sizes; and a single downward facing rubber bumper for contacting an upper surface of the rim of the plate; and the pin passing through the horizontal oval slot in the elongated lower tongue allowing the elongated lower tongue of the pivoting upper jaw to move forward and rearward in the vertical slot in the stationary lower jaw for engaging and disengaging the plurality of vertically spaced apart upward hooking hooks with the one downward hooking hook of the stationary lower jaw.

* * * * *